United States Patent [19]

Stoner

[11] Patent Number: 4,573,395

[45] Date of Patent: Mar. 4, 1986

[54] LINKLESS AMMUNITION MAGAZINE WITH SHELL BUFFER

[75] Inventor: Eugene M. Stoner, Palm City, Fla.

[73] Assignee: Ares, Inc., Port Clinton, Ohio

[21] Appl. No.: 563,152

[22] Filed: Dec. 19, 1983

[51] Int. Cl.[4] ..... F41D 10/22

[52] U.S. Cl. ..... 89/33.16; 89/33.4; 89/34; 198/792

[58] Field of Search ..... 89/33.1, 33.14, 33.16, 89/33.4, 33.5; 198/792

[56] References Cited

U.S. PATENT DOCUMENTS

| | | | |
|---|---|---|---|
| 2,489,428 | 11/1949 | Mariner | 89/34 |
| 3,101,647 | 8/1963 | Greene | 89/34 |
| 4,252,049 | 2/1981 | Franz et al. | 89/34 |
| 4,412,611 | 11/1983 | Golden | 89/34 |
| 4,424,735 | 1/1984 | Bacon et al. | 89/34 |
| 4,494,440 | 1/1985 | Koine | 89/33.16 |

*Primary Examiner*—Stephen C. Bentley
*Attorney, Agent, or Firm*—Allan R. Fowler

[57] ABSTRACT

A linkless ammunition magazine for guns includes an endless, shell-holding conveyor having two, spaced apart bicycle-type chains which are entrained over several pairs of guides that confine the conveyor to a convoluted path within a housing. During firing of an associated gun, an externally driven sprocket drives the conveyor in a direction advancing conveyor-held shells towards a shell transfer position located just downstream of the drive sprocket. A pair of guides located just upstream of the shell transfer position, is compliantly mounted to deflect in response to fast start up of the drive sprocket upon initiating of firing, in a direction enabling only a short segment of the conveyor upstream of the transfer position to move before further upstream portions of the conveyor start moving, fast shell feeding from the onset of firing being thereby enabled. A second pair of guides located downstream of the transfer position is also compliantly mounted, and is interconnected by a transfer arm with the first pair of compliantly mounted guides so as to deflect in unison therewith in a direction preventing any slack in the conveyor.

12 Claims, 5 Drawing Figures

LINKLESS AMMUNITION MAGAZINE WITH SHELL BUFFER

BACKGROUND OF THE INVENTION

1. Field of the Invention

The present invention is directed to the field of shell magazines for large guns, such as automatic cannon, and more particularly to linkless, conveyor-type shell magazines.

2. Description of the Prior Art

Many different types of large, rapid-fire or automatic cannon are used by the military in such varied applications as antiaircraft, anti-tank and aircraft armament systems. Because the firing rates of the cannon used in such applications are relatively high, and because of the time required to replenish associated shell magazines, the magazines are usually required to have large shell capacities. At the same time, magazine size and weight are also usually important factors to consider, and so dense shell packing in the magazines is ordinarily necessary. Obviously the magazines must also have the capability for rapidly delivering shells contained therein to a shell feeder associated with the magazine and gun.

According to gun and weapon system configuration, a number of different kinds of shell magazines or supplies have been produced for rapid-fire or automatic guns. Probably the simplest and least expensive shell supply is the belt-type in which shells are held in a side-by-side relationship. Originally, for small calibre weapons, these belts were made of fabric, loops being provided to hold the shells. Many, if not most, modern ammunition belts are of the metal link type, adjacent pairs of individual links being held together by the shells. Consequently, as the shells are extracted from the belt for firing, the belt disintegrates, the loose links typically being discharged and discarded with the fired shell casings.

A disadvantage of linked belt ammunition, particularly for use with large calibre guns, is that the loaded belts, even though usually considered as being flexible, are, in fact, relatively stiff and rigid. As a result, most ammunition belts cannot be tightly accordian folded in a manner providing high shell packing densities. Moreover, because belts of large calibre shells are very heavy when fully loaded, advancing of the belts to and through the associated gun requires a substantial amount of power. If the gun is self-powered, through use of high-pressure barrel gases or firing recoil, use of part of this power to advance the ammunition belt slows operation of the gun.

As an alternative to use of link-belted ammunition storage, some automatic or rapid-fire gun systems use cylindrical ammunition drum magazines in which rows of shells are loaded into a number of pie-shaped segments into which the magazine is divided. Each row of shells may hold 10 to 20 shells and 15 to 20 segments may be provided. The magazine drum is rotated so as to align a selected one of the shell-holding segments with a shell feeder which transfers shells from the selected segment to the associated gun for firing. Exemplary of such drum-type magazines is that disclosed in my prior U.S. Pat. No. 3,683,743.

An important advantage of many such segmented drum magazines is that a variety of different shell types can, if desired, be stored in different shell segments which can be selectively accessed. As an illustration, although most of the segments of the drum associated with an antiaircraft gun system are loaded with high explosive shells, some segments can be loaded with armor-piercing shells to enable the gun to operate in a secondary role as an anti-tank gun.

However, not all gun systems are required to have the dual role capability enabled by many drum-type magazines, and, for such other reasons as magazine space constraints or particular weapon system configuration, other types of shell magazines may be preferred. In particular, endless belt, linkless-type shell magazines are useful in many automatic gun systems, particularly airborne systems. In such linkless magazines, a ladder-like conveyor is looped over a number of guides which constrain the conveyor to a closely-folded, serpentine path within a magazine housing. Typically the conveyor has a bicycle chain-type configuration with the guides being correspondingly sprocket shaped. Shells are freely contained in the conveyor, between projecting pins or "rungs", and are confirned therein by dividing walls within the housing. One or more of the sprocket-shaped conveyor guides is driven, for example, by an electric or air motor, in a manner causing the conveyor to move shells towards a position from which they are extracted from the conveyor by a shell feeder. Because of the closely folded configurations of the conveyor, high shell packing densities can usually be achieved in such magazines.

Some gun system applications also require that fired shell casings be stored rather than be ejected from the system, as is a common practice. In particular, some airborne gun systems require the storing of fired shell casings so as to avoid the potential hazard to following, friendly aircraft posed by casings ejected from the aircraft. For this reason, at least some linkless-type shell magazines and associated feeders and guns are particularly configured for feeding fired shell casings back into the linkless magazine from which the shells are fed.

Known linkless conveyor-type shell magazines are typically configured for storing several hundred shells. As a result, the fully-loaded shell conveyors usually weigh many hundreds of pounds and, therefore, have considerable inertial resistance to start-up movement, thus making high instantaneous firing rates of the associated gun difficult to attain.

In some weapons systems utilizing linkless conveyor magazines, the high start-up inertial resistance of the loaded conveyor is overcome by use of high conveyor driving power. Because more power is required to provide rapid acceleration of the loaded conveyor from rest than is required to drive the conveyor once the conveyor is up to speed, the power source must, in such systems, be much greater than is otherwise necessary. This, in turn, causes system size, weight and power consumption to be increased. Moreover, the application of very high driving forces to the conveyor, to enable fast start-up movement, subjects parts of the magazine and conveyor to stresses which may reduce operational life and reliability of the magazines. To withstand such stresses, size and/or weight of the magazine may have to be increased, further adding to system size and weight.

As an alternative to providing such high start-up driving forces, some types of linkless conveyor magazines provide means whereby, during start up, only a few shells are advanced towards the associated shell feeder. These few shells are rapidly advanced while movement of the entire conveyor is less rapidly brought up to its full, shell-transferring velocity. As a result, the necessity for increased, conveyor driving power to accelerate the conveyor at a high rate upon initiation of firing is eliminated.

Heretofore to Applicant's knowledge, such apparatus enabling advancing of only a few shells at the initiating of firing have been relatively complex, and have hence been heavy, expensive and of questionable reliability and/or have not been particularly effective.

An object of the present invention is, therefore, to provide, for a linkless shell magazine having an endless-loop shell conveyor apparatus which enables, in response to start-up driving of the shell conveyor, just that segment of the conveyor immediately upstream adjacent to the shell transfer position, which contains only a few shells, to move before the rest of the conveyor starts moving, thereby enabling a high start-up firing rate.

Another object of the present invention is to provide, for a linkless shell magazine having an endless-loop shell conveyor, apparatus which enables instantaneous and temporary driving isolation, upon conveyor drive start-up, of a small segment of the conveyor which passes by a magazine shell transfer position, the rest of the conveyor being driven up to speed while shells are being fed to the gun from the first driven segment of the conveyor.

A further object of the present invention is to provide guiding for an endless-loop shell conveyor of a linkless shell magazine so that, upon conveyor driving start-up, only a short segment of the conveyor just upstream of a magazine shell transfer position is caused to be driven towards the transfer position before further upstream segments of the conveyor start moving.

Other objects, features and advantages of the present invention wll be readily apparent from the following detailed description when taken in conjunction with the accompanying drawings.

SUMMARY OF THE INVENTION

A shell magazine for guns, especially automatic or rapid fire cannon, comprises a flexible, movable shell conveyor configured for holding a number of shells in a serial relationship relative to one another and means for guiding the conveyor along a preselected path past a shell pick-up position. Driving means are connected for moving the conveyor along its preselected path so as to transport shells held in the conveyor to the shell pick-up position so that the shells can be picked up by an associated feeder and fed thereby to an associated gun for firing. The magazine further includes deflecting means connected to the conveyor guiding means for causing, in response to a fast start up of the driving means when firing of the associated gun is initiated, deflection of a portion of the guiding means, thereby causing shell transferring movement to the pick-up position of only the portion of the conveyor guided by the deflected portion of the guiding means in advance of general shell transporting movement of the entire conveyor.

The conveyor is formed in an endless-loop, belt form and the conveyor guiding means include a plurality of conveyor guides over which the conveyor is entrained. Comprising the deflecting portion are means enabling deflection of at least one of the conveyor guides in a direction causing movement of that portion of the conveyor passing over the deflected guide and between the deflected guide and the shell pick-up point in advance of general movement of the rest of the conveyor.

Further comprising the magazine is a magazine housing and means mounting the conveyor and conveyor guiding means in the housing. The mounting means includes means for movably mounting the deflectable guide to the housing and tensioning means for urging the deflectable guide toward an initial static position while permitting the deflectable guide to move in response to fast start up of the conveyor driving means.

The driving means are connected for driving the shell conveyor and the associated shell feeder and gun in a coordinated manner so that shells are transported by the conveyor to the magazine shell pick up position and the feeder picks up shells from the pick up position at the operational rate of the associated gun.

Also included in the deflecting means are second conveyor guide deflecting means connected to a conveyor guide which is mounted downstream of the shell pick up position. Means are provided for interconnecting the first-mentioned guide deflecting means and the second guide deflecting means so that the second guide deflecting means enable the taking up of the slack caused by deflection of the guide upstream of the shell pick-up position by the first-mentioned guide deflecting means.

As the associated gun starts firing, responsive to the conveyor driving means starting up to advance shells held in the magazine conveyor to the shell pick-up position, for picking up by the shell feeder, a conveyor guide upstream of the pick-up position is caused to deflect against a spring, with the effect that at start up only a short portion of the conveyor upstream of the pick-up position is driven towards the pick-up position by the driving means. Since the inertia of this initially moved small portion of the shell conveyor is low, shells can be advanced very rapidly towards the pick up position for feeding to the gun. As firing is continued, the rest of the shell conveyor is brought into motion by the driving means so that, after the first few shells are fired, the entire shell conveyor is in motion and is advancing shells at a substantially uniform rate towards the pick up position.

The downstream guide deflecting means deflect in an equal but opposite direction, being interconnected to the first-mentioned guide deflecting means so as to take up the slack in the conveyor caused thereby and prevent the conveyor from slipping off its guides. If fired shell casings are returned from the associated gun to the magazine, the second guide deflecting means are connected to a conveyor guide downstream of a shell casing insertion point so that, at the initiation of firing, the conveyor slack being taken up by the second deflecting means causes a portion of the conveyor downstream of the casing insertion point to also move before the general conveyor movement starts. Initial fast insertion of fired shell casings is thus also enabled.

BRIEF DESCRIPTION OF THE DRAWINGS

A better understanding of the present invention may be gained from a consideration of the following detailed description taken in conjunction with the accompanying drawings, in which.

DESCRIPTION OF THE PREFERRED EMBODIMENT

Figure 1:
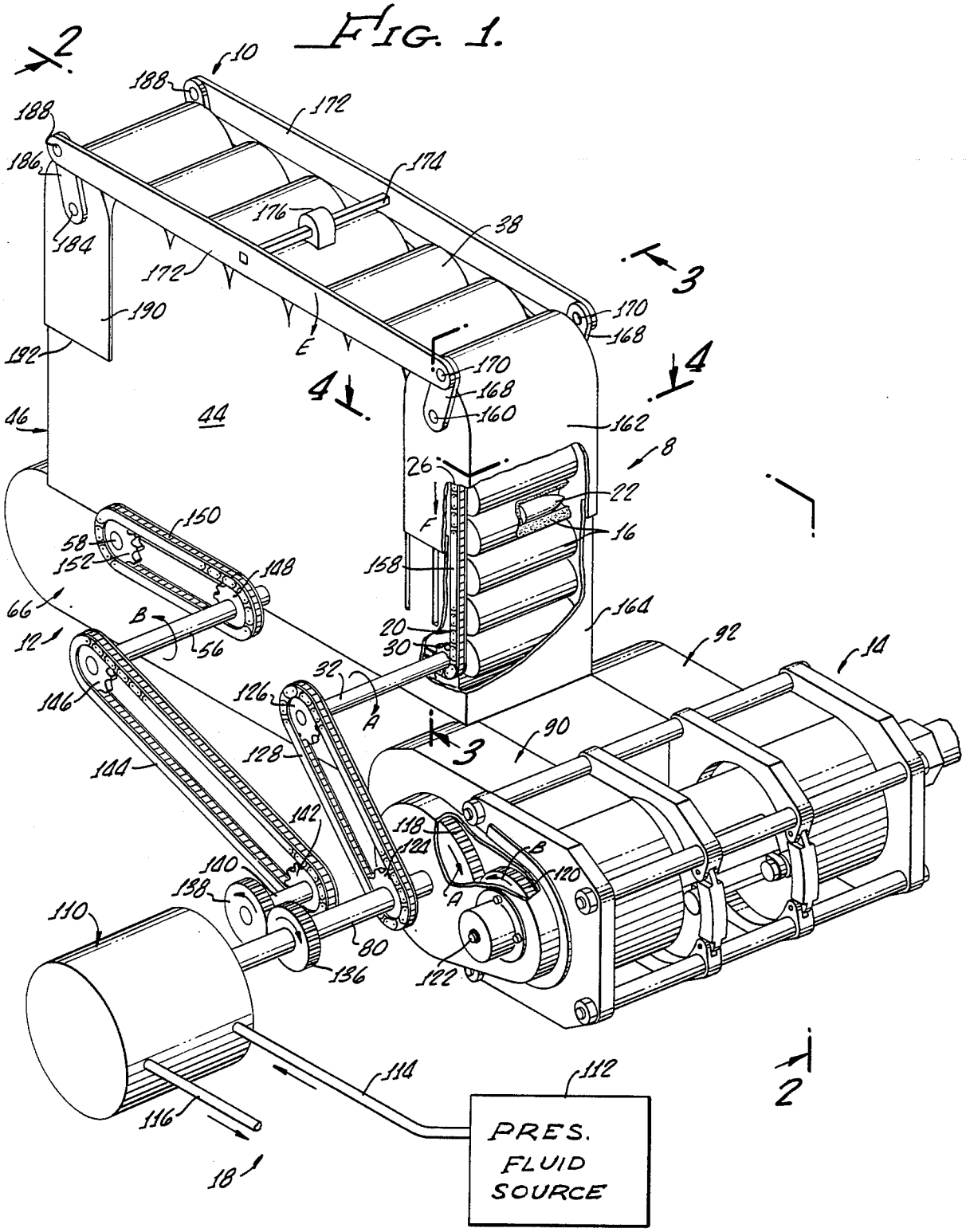
FIG. 1 is a partially cut-away perspective drawing showing the magazine with shell buffer, according to the present invention, associated with an exemplary, shell feeder and automatic gun.

A linkless, conveyor-type shell magazine 8, including shell buffering or accumulating means 10, according to the present invention, is shown in FIG. 1. An associated shell feeder 12 is shown operatively connected between magazine 8 and an associated gun or cannon 14 for feeding shells 16 from the magazine to the gun. Although gun 14 forms no part of the present invention, for illustrative purposes the gun is shown as being the rotary-type automatic cannon disclosed in my copending U.S. patent application Ser. No. 524,387.

As is more particularly described below, driving means 18 are connected for driving magazine 8, feeder 12 and gun 14 so that shells 16 are advanced by a driven, endless-loop conveyor 20 in the magazine to the feeder and are then fed by the feeder to the gun at a rate corresponding to the firing rate of the gun.

Magazine 8 and, more particularly, conveyor 20, are shown and described herein, for illustrating how the present invention may be used to advantage, as being configured for storing and transporting shells of a type in which a projectile 22 is fully recessed into a shell casing 24. In consequence, shells 16 are enabled to have a uniform, cylindrical shape, as contrasted to the tapered and necked-down shape of conventional shells. However, no limitation of magazine 8 or conveyor 20 to the use of telescoped shells 16 of the type shown is intended or implied, it being appreciated that the magazine and conveyor can alternatively be configured for use with shells of conventional shape.

When, however, magazine 8 and conveyor 20 are configured, in the manner shown and described herein, for use with cylindrical, telescoped shells, the magazine is readily adapted for the storing, after firing of shells 16 by gun 14, of shell casings 24 (FIG. 2) from which projectiles 22 have been fired. Accordingly, feeder 12 and gun 14 are configured, as more particularly described below, so that when conveyor 20 and the feeder and gun are driven by driving means 18, the feeder picks up shells 16 from the conveyor and delivers them to the gun for firing and after firing of the shells by the gun, the gun delivers casings 24 of shells 16 that have been fired back to the feeder which transports the casings back to empty regions of the conveyor.

Figure 2:
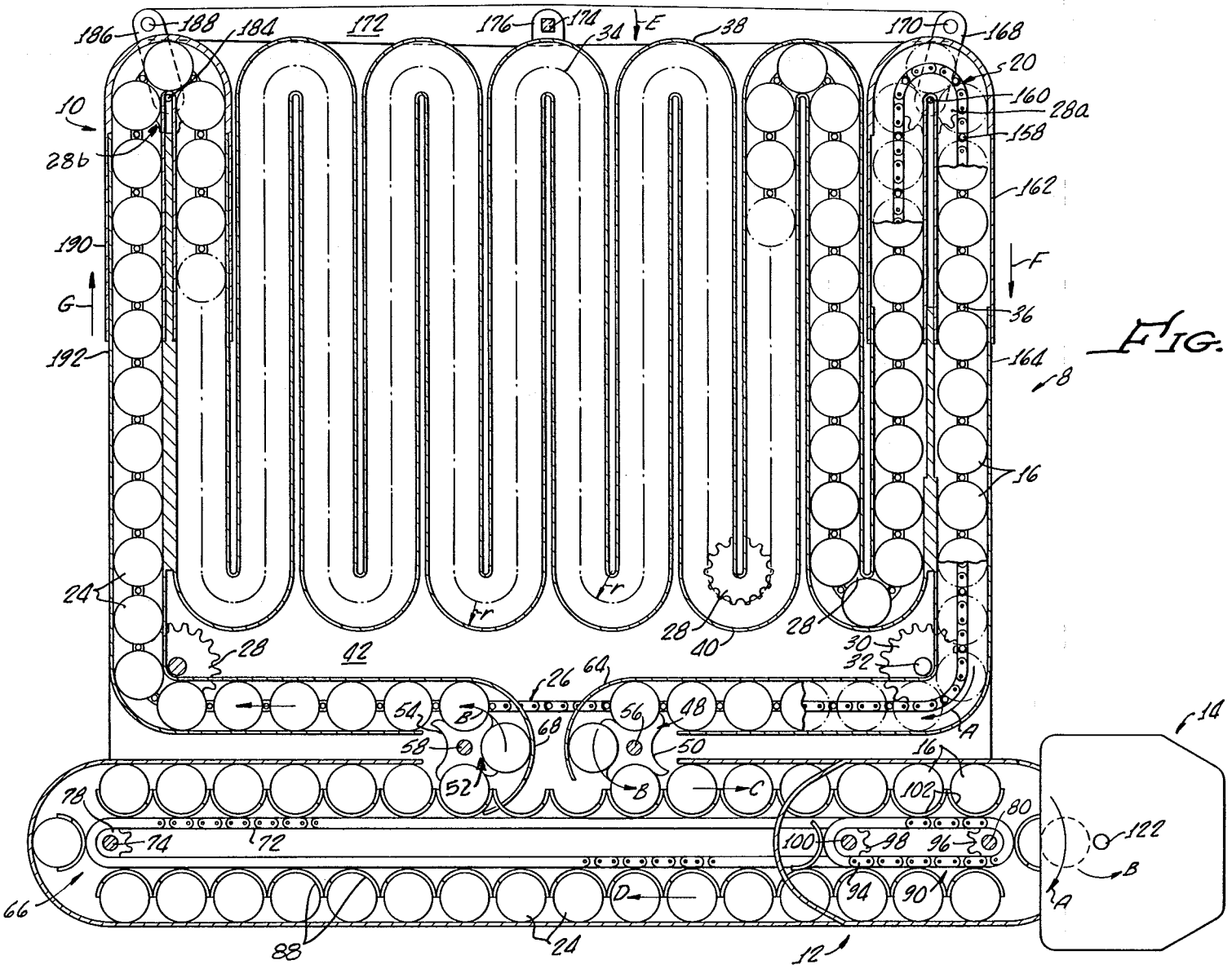
FIG. 2 is a cut-away view looking generally along line 2—2 of FIG. 1 showing internal construction of the magazine and shell buffer of FIG. 1 and illustrating a static, non-firing condition.
Figure 3:
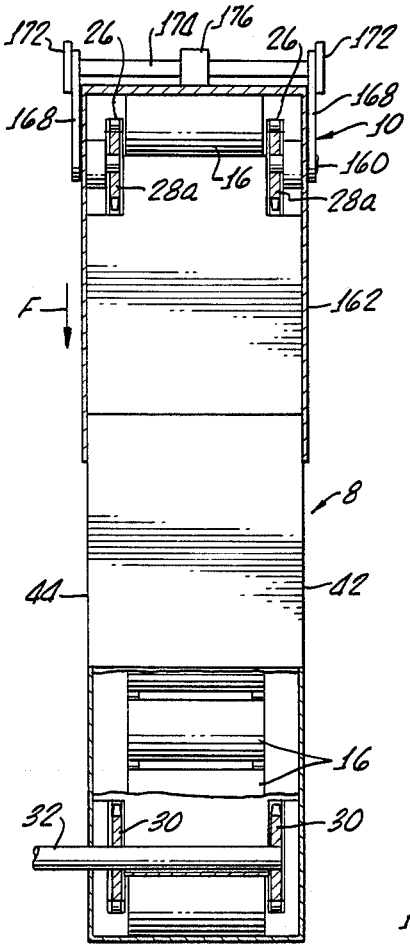
FIG. 3 is a transverse sectional view taken along line 3—3 of FIG. 1 showing, in greater detail, construction of the shell buffer.

Conveyor 20 comprises a pair of fore and aft, spaced apart, endless-loop elements 26 (FIGS. 1–3). Each element 26 is preferably constructed in the form of a bicycle-type chain so as to be strong in tension but very flexible in one plane. A plurality of sprocket-type conveyor guides 28 are rotatably mounted, in fore and aft pairs, within magazine 8. Included also are at least one pair of conveyor drive guides (sprockets) 30 mounted on a drive shaft 32, by means of which conveyor 20 is driven by driving means 18, as described below. Conveyor chain elements 26 are entrained over guides 28 and 30, the guides being arranged within magazine 8 so that conveyor 20 is constrained to a tightly folded, convoluted or serpentine path 34 (FIG. 2).

Figure 4:
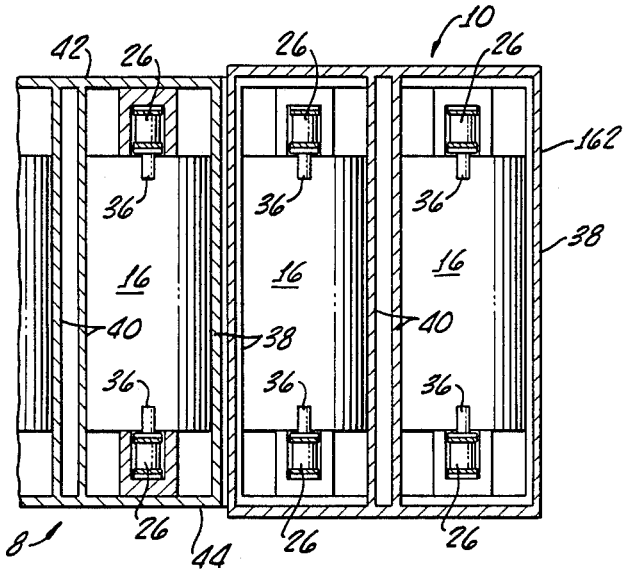
FIG. 4 is a cross-sectional view taken along line 4—4 of FIG. 1, also showing construction of the shell buffer.

A number of pairs of pins 36 (FIG. 4) project inwardly, in a fore or aft direction, from conveyor elements 26 in a manner supporting shells 16 of casings 24 between the two elements. Conveyor 16, therefore, somewhat resembles a ladder with pins 36 corresponding to ladder rungs, shells 16 or casings 24 being separately confined between adjacent "rungs" of the "ladder." Adjacent transverse outer and inner walls 38 and 40, respectively, of magazine 8, each spaced slightly over a shell radius, "r", from conveyor path 34 and extending in parallel relationship over substantially the entire path length, are provided for confining shells 16 and casings 24 in conveyor 20 between adjacent sets of pins 36 (FIG. 2). Thus, shells 16 (and casings 24, as may be applicable) are stored in conveyor 20 closely adjacent to one another, in a serial or side-by-side relationship, but are not actually linked together, as would be the case for linked-belt magazines. Transverse outer and inner walls 38 and 40 extend between magazine fore and aft walls 42 and 44 (FIGS. 1–4), walls, collectively forming a magazine housing 46.

As shown in FIG. 2, conveyor path 34 passes a transverse shell pick-off element 48 positioned at the interface between magazine 8 and shell feeder 12. Element 48 is in the shape of an elongated star wheel and, as shown, is formed having four arcuate shell-holding recesses 50. Conveyor path 34 also passes by a transverse casing transfer element 52 which is similar in shape to pick-off element 48 and which is located at the magazine-feeder interface outwardly of pick-off element 48. Casing transfer element 52 is formed having four arcuate casing holding recesses 54. Pick-off element 48 is fixed to a shaft 56 and transfer element 52 is fixed to a shaft 58. Both shafts 56 and 58 are driven by driving means 18, in a manner described below.

An arcuate inboard portion 64 of magazine inner wall 40 extends partially around shell pick-off element 48 to deflect shells 16 from magazine conveyor 20 into an endless-loop, feeder main conveyor 66, and thereby define a shell transfer port. In a similar manner an arcuate, outboard portion 68 of magazine inner wall 40 extends partially around casing transfer element 56 to guide casings 24 from feeder main conveyor 66 around the transfer element and into magazine conveyor 20 (FIG. 2) and thereby defines a casing transfer port.

Comprising feeder main conveyor 66 are two, fore and aft endless loop chains 72 entrained over an outboard pair of feeder conveyor sprockets 74 (FIG. 2) and over an inboard pair of sprockets (not shown). Outboard sprockets 74 are mounted on a shaft 78 and the inboard sprockets are mounted on a drive shaft 80 which, as described below, is rotated by driving means 18 to drive feeder main conveyor 66. Further comprising feeder main conveyor 66 are a number of arcuate, shell holding elements 88 which are connected to and between feeder conveyor chains 72 in a closely spaced, mutual side-by-side relationship. Shell-holding elements 88 are semicircular in cross-section and are oriented, relative to chains 72, so that longitudinal axes thereof are parallel to the longitudinal axes of shells 16 and casings 24 held in magazine conveyor 20.

To enable feeding of unfired shells 16 from magazine 8 to gun 14 and of shell casings 24 back to the magazine from the gun, exemplary shell feeder 12 is constructed having similar second and third shell conveyors 90 and 92, respectively. Second shell conveyor 90, shown in FIG. 2, comprises a pair of short, endless loop chains 94 entrained over a pair of inboard and outboard sprockets 96 and 98. Inboard sprockets 96 are fixed to drive shaft 80 so that second conveyor 90 is driven in unison with feeder main conveyor 66. Outboard sprockets 98 are mounted on an idler shaft 100. A number of shell-holding elements 102, identical to the above-described elements 88, are mounted between chains 94. Third conveyor 92 is constructed in the same manner as second conveyor 90 and all three feeder conveyors 66, 90 and 92 are parallel to one another.

Second conveyor 90 is mounted in feeder 12 rearwardly adjacent to feeder main conveyor 66 at inboard end regions thereof. Third conveyor 92 is similarly mounted in feeder 12 forwardly adjacent to main conveyor 66, so that it, too, operates through drive shaft 80, in unison with feeder main conveyor 66. Main conveyor shell holding elements 88, in regions adjacent to second and third conveyors 90 and 92, are aligned with second conveyor shell-holding elements 102 and with similar shell holding elements (not shown) of third conveyor 92. Guiding means (also not shown) are mounted in feeder 12 for automatically causing, in response to driven movement of conveyors 66, 90 and 92, (via common drive shaft 80) rearward transfer of shells 16 from upper, inboard regions of main conveyor 66 into second conveyor 90 and the rearward transfer of shell casings 24 from third conveyor 92 into lower, inboard regions of the main conveyor.

Feeder 12 is mounted to gun 14 so that feeder second conveyor 90 is in shell feeding relationship with a shell feeding port of the gun and feeder third conveyor 90 is in casing transfer relationship with a shell ejection port of the gun. Such configuration of feeder 12 is compatible with illustrated gun 14 which is configured for the axial feed through of shells and fired shell casings, enabled by use of cylindrical, telescoped shells 16.

By way of illustration, driving means 18 are shown (FIG. 1) to include motor 110 which may be a hydraulic motor that is fed pressurized hydraulic fluid from a source 112 through an inlet line 114. A fluid return line 116 is also connected to motor 110. Drive shaft 80 is connected to motor 110 for being driven in a clockwise direction as viewed from the rear of gun 14, (direction of Arrow "A"). A main gear 118 mounted on shaft 80 intermeshes with a gear 120 mounted on a main shaft 122 of gun 14. Clockwise driving of gear 118 causes gear 120, and hence, gun main shaft 122, to rotate counterclockwise (direction of Arrow "B") for operation of gun 14. As above-described, feeder conveyor sprocket 96, as well as similar sprockets associated with main conveyor 66 and third conveyor 92, are mounted on shaft 80, so that clockwise rotation of shaft 80, drives conveyors 66, 90 and 92 to transport shells 16 (by main and second conveyors 66 and 90) in an inward direction (Arrow "C" FIG. 2) from magazine 8 to gun 14, and to transport casings 24 outward (by third and main conveyors 92 and 66), in the direction of Arrow "D", from the gun back to the magazine.

Magazine conveyor 20 is driven by driving means 18 through sprockets 124 and 126 mounted, respectively, on motor shaft 80 and conveyor drive sprocket shaft 32 (to which magazine drive sprocket 30 is also mounted), sprockets 124 and 126 being drivingly interconnected by a drive chain 128 (FIG. 1). As a result, clockwise driving of shaft 80 causes conveyor drive sprocket 30 also to be driven in the clockwise direction (direction of arrow "A). As can be seen from FIG. 1, this clockwise driving of magazine drive sprocket 30 moves magazine conveyor 20 so as to advance shells 16 held in magazine conveyor 20 towards shell pick-off element 48 and moves casings 24 inserted into conveyor 20 away from casing transfer element 52.

To drive both shell pick-off and casing transfer elements 48 and 52 in the necessary counterclockwise direction (direction of arrow "B"), as is required to transfer shells 16 from magazine conveyor 20 to feeder main conveyor 66 and to transfer casings 24 from the feeder main conveyor to the magazine conveyor, a gear 136 is mounted on motor shaft 80 (FIG. 2). Gear 136 drivingly meshes with a gear 138 mounted on a transfer shaft 140, on which is also mounted a drive sprocket 142. A drive chain 144 is entrained over drive sprocket 142 and a sprocket 146 mounted on pick-off element shaft 56; also mounted on shaft 56 is a drive sprocket 148. A drive chain 150 is entrained over sprocket 148 and a sprocket 152 mounted on casing transfer element shaft 58. Both element shafts 56 and 58 are thereby caused to rotate in the counterclockwise direction (direction of arrow "B") in response to motor drive shaft 80 being driven in the clockwise direction (direction of arrow "A").

To enable magazine 8 to have a large shell holding capacity, conveyor magazine 20 necessarily needs to be relatively long and is, therefore, relatively heavy when fully loaded with shells 16. As an illustrative example, for use with telescoped 25 MM shells 16 having diameters of about two inches and each weighing about a pound, a magazine conveyor 20 configured for holding about 150 shells must be about 25 feet long and weighs about 200 pounds, including conveyor weight.

A high firing rate of associated gun 14 can be attained only by driving (by means 18) magazine conveyor 20 at a relatively high speed. To attain a desired firing rate of 2000 rounds per minute ($33\frac{1}{3}$ rounds per second), as is typical for the assumed 25 MM gun 14, a magazine conveyor 20 velocity of about 65–70 inches per second is required and to achieve such a high instantaneous firing rate within only one or two shell firings, as is important for automatic cannon which normally fire only short bursts, entire magazine conveyor 20, absent shell buffering means 10, would have to be accelerated to the mentioned full velocity in only about 0.03 to 0.06 seconds.

As, however, can readily be understood, the considerable mass of fully loaded magazine conveyor 20 causes the conveyor to have a high, at-rest inertia which impedes rapid conveyor acceleration when firing of gun 14 is initiated. Consequently, a much greater conveyor driving force must be applied by means 18 to cause rapid magazine conveyor acceleration to its full operational velocity than is necessary to merely sustain such velocity after the velocity has been attained. To provide the necessary, greater start-up forces to attain a high instantaneous firing rate of gun 14, driving means 18 would have to be substantially more powerful, or require substantially more power, than that needed for steady-state firing. Moreover, application to drive shaft 80 and drive sprockets 30 of the high power required to rapidly accelerate the entire, fully loaded magazine conveyor 20 to full operational velocity would subject the various parts involved to excessively high stresses, which might cause excessive parts wear, parts damage or premature parts failure.

Shell buffering or accumulating means 10 are, therefore, provided to eliminate the necessity for the application of excessively high start-up conveyor driving forces and to eliminate the problems caused thereby. According to the present invention, shell buffering means 10 are configured so as to enable a short segment 158 of magazine conveyor 20, which is just upstream of shell pick-off element 48, to be moved, at the initiation of firing, in advance of other, major portions of the conveyor. Stated otherwise, shell buffering means 10 enable, at conveyor start up, the temporary isolation or decoupling of short conveyor segment 158, which holds only a relatively few shells 16 and is, therefore, not very massive, from the rest of conveyor 20.

In general, and as more particularly described below the short magazine conveyor isolation or decoupling enabled by shell buffering means is accomplished by resiliently mounting some of the conveyor guide sprockets 28.

As start-up torque is applied to conveyor drive sprockets 30, (via shaft 32 through drive chain 128 and main drive shaft 80), the drive sprockets start pulling on magazine conveyor 20, causing a tension in portions of the conveyor upstream of the drive sprockets. In response to such start-up pulling on conveyor magazine 20, the resiliently mounted conveyor guide sprockets "give" or deflect in a direction reducing conveyor tension. As a result, only a relatively short segment 158 of magazine conveyor 20 is initially moved, towards and past shell pick-off rotor element 48, thereby reducing the start-up inertial load "seen" by driving means 18 and enabling a high instantaneous firing rate of gun 14 without use of excessive driving forces.

To achieve this end, magazine conveyor guide pair 28*a*, which is the first pair of conveyor guides upstream of conveyor drive sprocket 30, is mounted on a shaft 160 which is, in turn, mounted to a movable magazine housing segment 162. Such magazine housing segment 162 is mounted. in a telescoping relationship, over adjacent magazine housing portions 164; that is, housing segment 162, to which guide sprockets 28*a* are mounted by shaft 160, is free to slide downwardly (for the orientation shown in FIGS. 1 and 2) over magazine portions 164 in response to start-up tension in that segment 158 of magazine conveyor 20 which passes over guides 28*a*.

Figure 5:
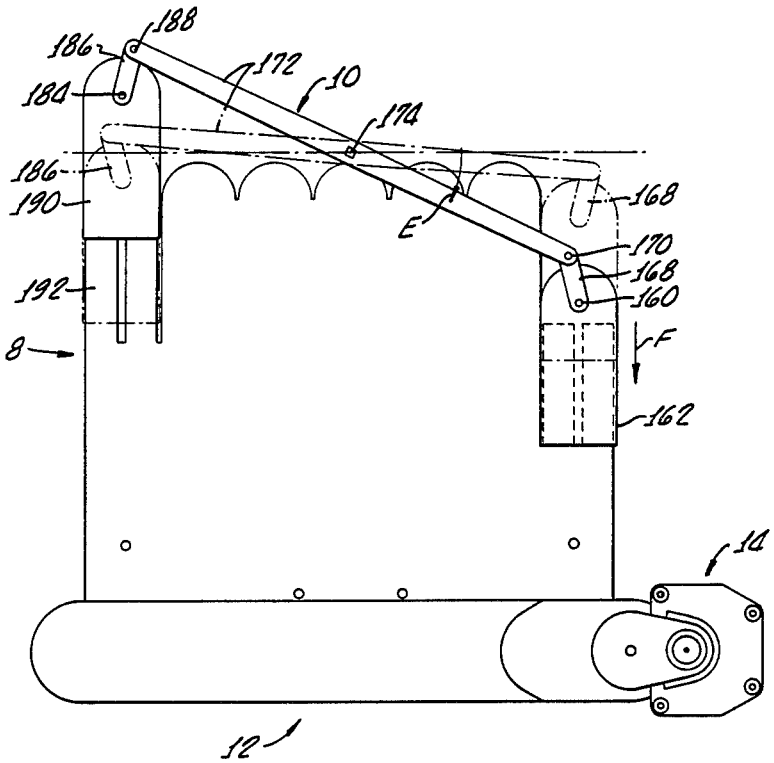
FIG. 5 is a diagram illustrating the shell buffer in operation; the condition at fast magazine start-up drive, for which shell conveyor guide deflection is at a maximum is shown in solid lines and the steady state or equilibrium firing condition, intermediate the static and fast start-up conditions, is shown in phantom lines.

Lower ends of short arms 168 are pivotally connected to ends of conveyor guide shaft 160. Upper ends of arms 168 are pivotally connected, by pins 170, to inboard ends of long arms 172 which, as shown, extend across upper regions of magazine 8. Long arms 172 are centrally connected to a torque bar 174 which is fixed to the top of magazine 8 by a bracket 176. Torque bar 174, acting through arms 172 and 168, provides the resilient mounting of conveyor guides 28*a* and, by pivoting in a clockwise direction (direction of Arrow "E", FIGS. 1 and 2), permits conveyor guides 28*a* to deflect towards drive sprockets 30 (direction of arrow "F") in response to a fast start up driving of such sprockets by drive means 18 (FIG. 5). When drive means 18 are not driving magazine conveyor sprockets 30, torque bar 174 causes magazine segment 162, to which guides 28*a* are mounted, to be at the static position depicted in FIGS. 1 and 2.

Upon initiating of firing, after deflection (in the direction of Arrow "F") of magazine housing segment 162 and conveyor guides 28*a* mounted therein has enabled shell feeding movement of conveyor segment 158 towards shell pick-off element 48, continued shell feeding movement of segment 158 is transmitted to further upstream portions of magazine conveyor 20. As a result, in a very short period of time, for example, in the time required for less than about 10 or 15 shells to be fired, the entire magazine conveyor 20 is moving at its maximum velocity associated with sustained firing at the full firing rate. During sustained firing, at magazine conveyor maximum velocity, arm 172 and magazine segment 162 will ordinarily remain slightly deflected, against the spring forces of torque bar 174, at an equilibrium position shown in phantom lines in FIG. 5.

Length of magazine conveyor 20 obviously remains constant, regardless of the amount of deflection of conveyor guides 28*a*. However, it is apparent that when, during firing, and particularly at the initiating of firing, conveyor drive sprockets 28*a* are deflected (pulled) towards conveyor drive sprockets 30, the length of conveyor path 34 is necessarily shortened and, absent take-up means, portions of conveyor 20 downstream of the drive sprockets would become undesirably slack.

To prevent the formation of any such magazine conveyor slack, shell buffering means 10 include means for compliantly mounting at least one pair of magazine conveyor guides 28*b* which are located in magazine 8 relatively close, in a downstream direction, to conveyor drive sprockets 30 (FIG. 2). As described below, during firing operation of magazine 8, conveyor guides 28*b* are caused to deflect, relative to deflection of guides 28*a*, an amount taking up any conveyor slack which would otherwise be caused by deflection of guides 28*a* alone. Ends of a shaft 184 on which magazine conveyor 28*b* are mounted, are, therefore, pivotally connected to short arms 186 which are identical in length to above-described arms 168. Arms 186 are, in turn, pivotally connected to outboard ends of long arms 172 by pivot pins 188.

Torque bar 174 is connected to arms 172 midway between connecting pins 170 and 188. Arms 168, 172 and 186 are arranged so that when magazine conveyor guides 28*a* are pulled downwardly (direction of Arrow "F") by start-up driving of conveyor drive sprockets 30, a distance "d" from the static (non-operational) position, conveyor take-up guides 28*b* are pulled upwardly (direction of Arrow "G") the same distance "d." As a direct result of motion of conveyor guides 28*a* being directly transmitted by transfer arm 172 to conveyor guides 28*b*, the length of magazine path 34 always stays constant and no slack is ever caused in conveyor 20. Magazine conveyor guides 28*b* are mounted, via shaft 184, to a slidable magazine housing segment 190 which telescopingly slides up and down over a fixed magazine housing portion 192.

As the result of the compliant mounting of conveyor guides 28*a* and 28*b*, conveyor segment 158, which is moved by conveyor drive sprockets 30 in advance of the rest of magazine conveyor 20, can be seen to extend between and around both pairs of compliantly mounted conveyor guides 28*a* and 28*b* and to pass over drive sprockets 30 and past shell pick-off element 48 and casing transfer element 52. Conveyor segment 158, therefore, necessarily travels past both such transfer elements 48 and 52 at the same velocity, even during initial start-up when segment 158 is effectively isolated or decoupled from the rest of conveyor 20, as is necessary for proper transfer of shells 16 from conveyor 28 to feeder conveyor 66 and of casings 24 from such feeder conveyor into the magazine conveyor.

Because of the above described driving arrangements, by means 18, of magazine 8 and shell feeder, feeder main conveyor 66, as well as feeder first and second conveyors 90 and 92, are always driven at the same linear velocity as that at which magazine conveyor segment 158 is driven; as is required for proper shell and causing transfer between the conveyors.

It will, of course, be understood that as described herein magazine conveyor segment 158 is merely that relatively short portion of magazine conveyor that, at any instant of time, extends between and over conveyor guides 28*a* and 28*b* and which also is entrained over drive sprockets 30 and passes shell and casing transferring elements 48 and 52. Inasmuch as whenever gun 14 is fired, entire magazine conveyor 20 is ordinarily advanced a distance related to the number of shells fired, different actual sections of the conveyor occupy the position corresponding to that defined as conveyor segment 158, and segment 158 does not, accordingly, define any particular portion of conveyor 20.

Preferably, as shown and described herein, shell magazine 8, including shell buffering means, is integrated with shell feeder 14. Accordingly shell pick-off element 48 and casing transfer element 52 can be considered to form part of either magazine 8 or shell feeder 14, and, in fact, such elements constitute an interface between the magazine and feeder. As is evident, integration of the magazine 8 and feeder 14 together assures the proper transferring of shells 16 and casings 24 between the magazine and feeder by maintaining all parts in their proper respective spatial relationships. Moreover, by such integration of magazine 8 and feeder 14, the number of parts required is minimized. It should, however, be appreciated that integration of magazine 8 and feeder 14 in the described manner is not essential and the magazine and feeder may be independently constructed in a manner which will be obvious to those skilled in the ammunition feeding art.

Although there has been described above a specific arrangement of a linkless-type shell magazine with shell accumulation in accordance with the present invention for purposes of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the appended claims.

What is claimed is:

1. Linkless shell magazine apparatus for storing unfired shells to be fed to an associated gun and for storing casings of shells fired by said associated gun, said magazine comprising:

(a) a shell magazine housing having an unfired shell out-feed port and a fired shell casing in-feed port;

(b) an endless-loop, magazine shell and casing conveyor having means for holding a number of shells or casings in a serial, side-by-side relationship;

(c) conveyor guiding means mounted in said housing, said conveyor being entrained over said guiding means, said guiding means causing the conveyor entrained thereover to follow a serpentine path through the magazine which passes by, in shell and casing transferring relationship, the shell out-feed port and the casing in-feed port;

(d) driving means connected for moving the conveyor along the conveyor path in a direction transporting shells held in the conveyor towards the shell out-feed port and transporting casings transferred into vacancies in the conveyor through the casing in-feed port away from said in-feed port; and, (e) shell accumulating means, responsive to a fast start up of the driving means at the initiation of firing of the associated gun, for enabling a first, short portion, relative to the entire length, of the conveyor just upstream of the shell out-feed port and a second, short portion, relative to the entire length, of the conveyor just downstream of the casing in-feed port to move in unison before other, major portions of the conveyor start moving so as to enable, upon conveyor start up, at the initiating of firing of said associated gun, temporary decoupling of said first and second short conveyor portions from said major conveyor portion.

2. The shell magazine apparatus according to claim 1, wherein said driving means include a power source and a conveyor driving element, said power source being drivingly connected to the conveyor driving element, wherein the conveyor guiding means comprise a plurality of conveyor guide elements over which the conveyor is entrained and wherein said shell accumulating means include means for compliantly mounting at least one of the conveyor guide elements upstream adjacent to the conveyor drive element so as to enable said compliantly mounted element to deflect in a direction causing, during fast start up of said driving means upon initiating of firing, the effective decoupling of said portion of the magazine conveyor upstream of the shell out-feed port from the rest of the magazine conveyor.

3. The shell magazine apparatus according to claim 1 including shell feeding means for transporting shells from said shell magazine out-feed port to said associated gun and for transporting fired shell casings from said gun to said magazine casing in-feed port.

4. Linkless shell magazine apparatus for storing unfired shells to be fed to an associated gun and for storing casings of shells fired by said associated gun, said magazine comprising:

(a) a shell magazine housing having an unfired shell out-feed port and a fired shell casing in-feed port;

(b) an endless-loop magazine shell and casing conveyor having means for holding a number of shells or casings in a serial, side-by-side relationship;

(c) conveyor guiding means mounted in said housing, said conveyor being entrained over said guiding means, said guiding means causing the conveyor entrained thereover to follow a serpentine path through the magazine which passes by, in shell and casing transferring relationship, the shell out-feed port and the casing in-feed port;

(d) driving means connected for moving the conveyor along the conveyor path in a direction transporting shells held in the conveyor towards the shell out-feed port and transporting casings transferred into vacancies in the conveyor through the casing in-feed port away from said in-feed port, said driving means including a power source and a conveyor driving element, said power source being drivingly connected to the conveyor driving element, wherein the conveyor guiding means comprise a plurality of conveyor guide elements over which the conveyor is entrained;

(e) shell accumulating means, responsive to a fast-start up of the driving means at the initiation of firing of the associated gun, for enabling a portion of the conveyor upstream adjacent of the shell out-feed port and downstream of the casing in-feed port to move before the rest of the conveyor starts moving, said shell accumulating means include means for compliantly mounting at least one of the conveyor guide elements upstream adjacent to the conveyor drive element so as to enable said compliantly mounted element to deflect in a direction causing, during fast start up of said driving means upon initiating of firing, the effective decoupling of said portion of the magazine conveyor upstream of the shell out-feed port from the rest of the magazine conveyor and further including means for compliantly mounting at least one of the conveyor guide elements downstream adjacent to the casing in-feed port so as to enable the taking up of any slack created in said decoupled portion of the conveyor caused by deflection of said upstream guide element.

5. The shell magazine apparatus according to claim 2 including means for interconnecting said compliantly mounted upstream and downstream conveyor guide elements so that said elements move equal amounts in opposite directions so as to maintain a magazine conveyor travel path of constant length.

6. The shell magazine apparatus according to claim 4 wherein said interconnecting means comprise an elongate transfer arm connected to said compliantly mounted upstream and downstream guide elements.

7. The shell magazine apparatus according to claim 6 wherein said interconnecting means include spring means for urging said transfer arm towards a static, non-firing position whenever said arm is moved from said position by said driving means during firing of said gun.

8. The shell magazine apparatus according to claim 4 wherein said shell feeding means include a shell and casing transfer conveyor and wherein said apparatus further includes means for transferring shells, past the shell out-feed port, from the magazine conveyor into said transfer conveyor and from said transfer conveyor past the casing in-feed port, into the magazine conveyor.

9. Linkless shell magazine apparatus for storing ammunition to be fired by an associated, rapid-fire gun, said apparatus comprising:

(a) a magazine housing;

(b) an endless-loop, chain-type conveyor having means for holding a number of free shells in a side-by-side relationship;

(c) means for mounting said conveyor in said magazine housing, said mounting means including a plurality of conveyor guides over which said conveyor is entrained, said guides being arranged to constrain the conveyor to a serpentine path in the housing, said guides including at least one sprocket-type drive element, said mounting means compliantly mounting at least one of the guides which are upstream adjacent to said drive element so as to permit deflecting of said upstream guide in response to a fast start up of said drive element in a direction enabling the portion of the conveyor passing over said drive element to move in a shell feeding direction towards a shell transfer position in advance of movement of further upstream portions of the conveyor, said mounting means also compliantly mounting at least one of said guides which are downstream adjacent to said drive element so as to permit deflecting of said downstream guide;

(d) means for interconnecting said compliantly mounted upstream and downstream conveyor guides so that, in response to deflection of the compliantly mounted upstream guide caused by a fast start-up of the drive element, the compliantly mounted downstream guide deflects in a manner taking up any slack in the conveyor caused by the deflection of the compliantly mounted upstream guide;

(e) driving means connected to the conveyor drive element for driving said element in said shell transporting direction; and (f) means connected to said driving means for inserting fired shell casings into said conveyor, said casing inserting means including a rotatably mounted star wheel positioned downstream of said conveyor driving element, intermediate said element and said compliantly mounted downstream conveyor guide, said star wheel being connected to said driving means.

10. Linkless shell magazine apparatus for storing ammunition to be fired by an associated, rapid-fire gun, said apparatus comprising:

(a) a magazine housing;

(b) an endless-loop, chain-type conveyor having means for holding a number of free shells in a side-by-side relationship;

(c) means for mounting said conveyor in said magazine housing, said mounting means including a plurality of conveyor guides over which said conveyor is entrained, said guides being arranged to constrain the conveyor to a serpentine path in the housing, said guides including at least one sprocket-type drive element, said mounting means compliantly mounting at least one of the guides which are upstream adjacent to said drive element so as to permit deflecting of said upstream guide in response to a fast start up of said drive element in a direction enabling the portion of the conveyor passing over said drive element to move in a shell feeding direction towards a shell transfer position in advance of movement of further upstream portions of the conveyor, said mounting means also compliantly mounting at least one of said guides which are downstream adjacent to said drive element so as to permit deflecting of said downstream guide;

(d) means for interconnecting said compliantly mounted upstream and downstream conveyor guides so that, in response to deflection of the compliantly mounted upstream guide caused by a fast start-up of the drive element, the compliantly mounted downstream guide deflects in a manner taking up any slack in the conveyor caused by the deflection of the compliantly mounted upstream guide;

(e) driving means connected to the conveyor drive element for driving said element in said shell transporting direction; and, (f) shell feeding means for transporting shells from said conveyor to the associated gun for firing and for transporting fired shell casings from the gun back to said conveyor, said shell feeding means including transferring means connected to said driving means for transferring shells transported by the conveyor to the shell transfer position from the conveyor to the shell feeding means and for transferring shell casings from the shell feeding means into the conveyor at a casing insertion position which is downstream of said shell transfer position.

11. The shell magazine apparatus according to claim 10 wherein said transferring means include a first star wheel rotatably mounted at said shell transfer position and a second star wheel mounted at said casing transfer position, said first and second star wheels being connected to said driving means for being rotatably driven thereby.

12. Linkless shell magazine apparatus for storing unfired shells to be fed to an associated fun, said magazine comprising:

(a) a shell magazine housing having an unfired shell out-feed port;

(b) an endless-loop magazine shell and casing conveyor having means for holding a number of shells or casings in a serial, side-by-side relationship;

(c) conveyor guiding means mounted in said housing, said conveyor being entrained over said guiding means, said guiding means causing the conveyor entrained thereover to follow a serpentine path through the magazine which passes by, in shell transferring relationship, the shell out-feed port;

(d) driving means connected for moving the conveyor along the conveyor path in a direction transporting shells held in the conveyor towards the shell out-feed port, said driving means including a power source and a conveyor driving element, said power source being drivingly connected to the conveyor driving element, wherein the conveyor guide means comprise a plurality of conveyor guide elements over which the conveyor is entrained; and (e) shell accumulating means, responsive to a fast-start up of the driving means at the initiation of firing of the associated gun, for enabling a portion of the conveyor upstream and downstream adjacent to the shell out feed port to move before the rest of the conveyor starts moving, said shell accumulating means including means for compliantly mounting at least one of the conveyor guide elements upstream adjacent to the conveyor drive element so as to enable said compliantly mounted element to deflect in a direction causing, during fast start up of said driving means upon initiating of firing, the effective decoupling of said portion of the magazine conveyor upstream of the shell out-feed port from the rest of the magazine conveyor; and further including means for compliantly mounting at least one of the conveyor guide elements downstream of the shell out feed port so as to enable the taking up of any slack created in said decoupled portion of the conveyor caused by deflection of said upstream guide element.

* * * * *